US009096057B2

(12) United States Patent
Hays et al.

(10) Patent No.: US 9,096,057 B2
(45) Date of Patent: Aug. 4, 2015

(54) WORKING FLUIDS FOR HIGH FREQUENCY ELEVATED TEMPERATURE THERMO-PNEUMATIC ACTUATION

(71) Applicant: XEROX CORPORATION, Norwalk, CT (US)

(72) Inventors: Andrew W. Hays, Fairport, NY (US); Jun Ma, Penfield, NY (US)

(73) Assignee: XEROX CORPORATION, Norwalk, CT (US)

( * ) Notice: Subject to any disclaimer, the term of this patent is extended or adjusted under 35 U.S.C. 154(b) by 35 days.

(21) Appl. No.: 14/072,213

(22) Filed: Nov. 5, 2013

(65) Prior Publication Data

US 2015/0124012 A1 May 7, 2015

(51) Int. Cl.

| | |
|---|---|
| ***B41J 2/05*** | (2006.01) |
| ***B41J 2/07*** | (2006.01) |
| ***B41J 2/16*** | (2006.01) |

(52) U.S. Cl.

CPC .... *B41J 2/05* (2013.01); *B41J 2/07* (2013.01); *B41J 2/16* (2013.01)

(58) Field of Classification Search

CPC ..... B41J 2/14427; B41J 2/14; B41J 2002/14346; B41J 2/04585; B41J 2/14112

USPC ..... 347/9, 20, 54, 56, 60, 61, 63, 65, 68

See application file for complete search history.

(56) References Cited

U.S. PATENT DOCUMENTS

| | | | |
|---|---|---|---|
| 5,467,112 | A | 11/1995 | Mitani |
| 5,539,437 | A | 7/1996 | Penwell |
| 5,684,519 | A | 11/1997 | Matoba et al. |
| 6,074,043 | A | 6/2000 | Ahn |
| 6,130,690 | A | 10/2000 | Ahn |
| 6,186,617 | B1 | 2/2001 | Ahn |
| 6,199,600 | B1 | 3/2001 | Ahn et al. |
| 6,206,505 | B1 | 3/2001 | Yoshihira et al. |
| 6,270,197 | B1 | 8/2001 | Ahn et al. |
| 6,270,198 | B1 | 8/2001 | Ahn et al. |
| 6,276,783 | B1 | 8/2001 | Ishinaga et al. |
| 6,284,436 | B1 | 9/2001 | Ahn et al. |
| 6,286,940 | B1 | 9/2001 | Sugiyama et al. |
| 6,312,109 | B1 | 11/2001 | Chen |
| 6,328,430 | B1 | 12/2001 | Ahn et al. |
| 6,334,670 | B1 | 1/2002 | Yoshihira et al. |
| 6,367,705 | B1 | 4/2002 | Lee et al. |
| 6,378,991 | B1 | 4/2002 | Lim et al. |
| 6,386,686 | B1 | 5/2002 | Kubota et al. |
| 6,390,604 | B2 | 5/2002 | Kashino et al. |

(Continued)

FOREIGN PATENT DOCUMENTS

| | | | |
|---|---|---|---|
| EP | 0811492 | A2 | 12/1997 |
| EP | 0816083 | A3 | 9/1998 |

(Continued)

*Primary Examiner* — An Do

(74) *Attorney, Agent, or Firm* — MH2 Technology Law Group LLP

(57) ABSTRACT

Provided is a thermo-pneumatic actuator which can include a substrate, an insulating layer formed on the substrate, a working fluid disposed in a fluid chamber, an ink chamber separated from the fluid chamber by at least a portion of the device layer comprising an actuatable membrane, and a heating element formed between the insulating layer and the fluid chamber. A boiling point temperature of the working fluid in the fluid chamber is in the range of greater than about 100° C. to about 500° C.

17 Claims, 5 Drawing Sheets

(56) References Cited

U.S. PATENT DOCUMENTS

| | | | |
|---|---|---|---|
| 6,431,688 | B1 | 8/2002 | Shin et al. |
| 6,436,301 | B1 | 8/2002 | Hiroki et al. |
| 6,443,562 | B1 | 9/2002 | Yoon |
| 6,517,198 | B2 | 2/2003 | Yoshihira et al. |
| 6,540,336 | B2 | 4/2003 | Kubota et al. |
| 6,705,716 | B2 | 3/2004 | Mott |
| 6,719,408 | B2 | 4/2004 | Yoshihira et al. |
| 6,832,015 | B2 | 12/2004 | Childers |

FOREIGN PATENT DOCUMENTS

| | | | |
|---|---|---|---|
| EP | 0999051 | A3 | 11/2000 |
| EP | 1136271 | A1 | 9/2001 |
| GB | 2286157 | | 8/1995 |
| JP | 64027954 | | 1/1989 |

WORKING FLUIDS FOR HIGH FREQUENCY ELEVATED TEMPERATURE THERMO-PNEUMATIC ACTUATION

TECHNICAL FIELD

The present teachings relate to the field of ink jet printing devices and, more particularly, to working fluids for ink jet printhead actuators.

BACKGROUND

Drop on demand ink jet technology is widely used in the printing industry. Printers using drop on demand ink jet technology can use either thermal ink jet (TIJ) technology or piezoelectric (PZT) technology. In contrast to thermal ink jet printheads, printheads using piezoelectric technology are more expensive to manufacture but may use a wider variety of inks. Piezoelectric printheads are also relatively larger than thermal printheads for the same nozzle count, which may require a wider spacing of nozzles from which ink is ejected during printing and result in a lower ink drop density and velocity. Low drop velocity decreases the tolerance for drop velocity variation and directionality which, in turn, may decrease image quality and printing speed.

Piezoelectric ink jet printheads may include an array of piezoelectric elements (i.e., transducers). One process to form the array can include detachably bonding a blanket piezoelectric layer to a transfer carrier with an adhesive, and dicing the blanket piezoelectric layer to form a plurality of individual piezoelectric elements. A plurality of dicing saw passes can be used to remove all the piezoelectric material between adjacent piezoelectric elements to provide the correct spacing between each piezoelectric element.

Piezoelectric ink jet printheads can typically further include a flexible diaphragm to which the array of piezoelectric elements is attached. When a voltage is applied to a piezoelectric element, typically through electrical connection with an electrode electrically coupled to a power source, the piezoelectric element bends or deflects, causing the diaphragm to flex which expels a quantity of ink from a chamber through a nozzle. The flexing further draws ink into the chamber from a main ink reservoir through an opening to replace the expelled ink.

Thermal ink jet printheads include a thermal energy generator or heater element, usually a resistor, separated from a nozzle within a nozzle plate by an ink channel. Each heater element may be individually addressed so that an activation of an electrical pulse heats the resistor. The heat is transferred from the heater to the ink, which causes a bubble to form within the ink. For example, a water-based ink reaches a critical temperature of 280° C. for bubble nucleation. The nucleated bubble or water vapor thermally isolates the ink from the heater element to prevent further transfer of heat from the resistor to the ink, and the electrical pulse is deactivated. The nucleating bubble expands until excess heat diffuses away from the ink. During the expansion of the vapor bubble, the ink is forced toward the nozzle and begins to bulge at the exterior of the nozzle plate, but is contained by surface tension of the ink as a meniscus.

When the electrical pulse is deactivated, excess heat diffuses away from the ink and the bubble begins to contract and collapse. The ink within the channel between the bubble and the nozzle begins to move toward the contracting bubble, causing a separation of the ink bulging from the nozzle plate and forms an ink droplet. Acceleration of ink out of the nozzle during the expansion of the bubble provides the momentum and velocity to expel the ink droplet from the nozzle toward a recording medium such as paper in a substantially straight line direction. Once the ink is ejected from the nozzle, the channel may be re-fired after a delay that is sufficient to enable refilling of ink within the channel. A thermal printhead design is discussed in U.S. Pat. No. 6,315,398, incorporated herein by reference in its entirety.

Another type of printhead includes the use of thermo-pneumatic actuators (TPA's). TPA's are similar to thermo-pneumatic (TP) micro-pumps, but do not include inlet and outlet valves. Most printheads rely on surface tension, meniscus pressures, and ink flow impedance to manage fluid flow. In contrast, printheads employing the use of TPA's use a membrane to separate an active or pumped fluid (e.g., an active fluid such as an ink which is pumped out of the printhead) from a working or trapped fluid that is sealed within each actuator. Because the ink itself may have less than optimal thermal characteristics, the working fluid is selected for its improved thermal performance during operation of the device. The membrane isolates the working fluid and prevents it from mixing with the pumped fluid. A lower half of the TPA (the portion beneath the membrane) includes a resistive heater and the working fluid, while the upper half of the TPA (the portion between the membrane and the nozzle plate) includes the pumped fluid. The heater, which, in an array comprising a plurality of heaters, can be individually addressed and activated so that it is energized to heat the working fluid to a point close to its critical temperature. As a result, nucleation sites appear in the working fluid that coalesce to form rapidly growing vapor bubble as described for the bubbles in a thermal ink jet but formed in the working fluid. The bubble grows, deflects the membrane and the active fluid is pressurized in its fluid path. Accordingly, the membrane is an actuatable membrane. The pressure pulse causes the active fluid to move or transmit pressure in a useful way such as being ejected from a nozzle and onto a recording medium such as paper. A similar configuration used for a hybrid ink jet print head is described in U.S. Pat. No. 5,539,437, which is incorporated herein by reference in its entirety.

Thermo-pneumatic actuators are used as fluidic pumps as well as droplet ejectors but are limited in their actuation frequency because of thermal buildup. For example, operation of such devices is accompanied by a baseline temperature rise until the heat input is matched by the heat loss to the environment. At this point, the device reaches an elevated steady state temperature. However, if the boiling point of the working fluid is below the steady state temperature then actuation will cease, rendering the actuator inoperable. That is, as the actuator is cycled, excess heat raises the temperature of the working fluid until its boiling point is exceeded at which point it completely vaporizes rather than only a portion to form the bubbles that act against the membrane. Accordingly, thermo-pneumatic actuation is limited in cycling frequency due to the length of time it takes for the device to cool off between cycles.

A printhead device design and manufacturing process that allows for operation at elevated temperatures to improve frequency response would be desirable.

SUMMARY

The following presents a simplified summary in order to provide a basic understanding of some aspects of one or more embodiments of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later.

In an embodiment of the present teachings there is a thermo-pneumatic actuator, including: a substrate, an insulating layer formed on the substrate, a working fluid disposed in a fluid chamber, an ink chamber separated from the fluid chamber by at least a portion of the device layer comprising an actuatable membrane, and a heating element formed between the insulating layer and the fluid chamber. A boiling point temperature of the working fluid in the fluid chamber is in the range of greater than about 100° C. to about 500° C.

In another embodiment of the present teachings, there is a method for forming a thermo-pneumatic actuator. The method can include forming an insulating layer on a substrate, forming a fluid chamber, forming a heating element between the insulating layer and the fluid chamber, forming a device layer comprising an actuatable membrane, forming an ink chamber separated from the fluid chamber by at least a portion of the device layer, and at least partially filling a volume of the fluid chamber with the working fluid. A boiling point temperature of the working fluid in the fluid chamber is in the range of greater than about 100° C. to about 500° C.

In another embodiment of the present teachings there is method of operating a thermo-pneumatic actuator. The method can include providing a thermo-pneumatic actuator that includes a substrate, an insulating layer formed on the substrate, a working fluid disposed in a fluid chamber, an ink chamber separated from the fluid chamber by at least a portion of the device layer comprising an actuatable membrane, and a heating element formed between the insulating layer and the fluid chamber; activating the heating element to heat at least a portion of the working fluid such that at least a vapor bubble forms in the fluid chamber; and actuating the actuatable membrane to cause the ejection of ink from the ink chamber. In the method, a boiling point temperature of the working fluid in the fluid chamber is in the range of greater than about 100° C. to about 500° C.

One advantage of at least one embodiment is that high frequency actuation can be attained by maintaining the actuator at elevated temperature, thereby causing a higher temperature gradient for heat loss. Accordingly, the operating temperature can be maintained at a constant level due to a higher maximum steady state temperature achieved during operation. Thus, while in operation the actuator would be energized by supplying excess heat to the device, power delivered to maintain the temperature in the actuator is reduced.

BRIEF DESCRIPTION OF THE DRAWINGS

The accompanying drawings, which are incorporated in and constitute a part of this specification, illustrate embodiments of the present teachings and together with the description, serve to explain the principles of the disclosure. In the figures.

It should be noted that some details of the FIGS. have been simplified and are drawn to facilitate understanding of the present teachings rather than to maintain strict structural accuracy, detail, and scale.

DETAILED DESCRIPTION

Reference will now be made in detail to exemplary embodiments of the present teachings, examples of which are illustrated in the accompanying drawings. Wherever possible, the same reference numbers will be used throughout the drawings to refer to the same or like parts.

As used herein, unless otherwise specified, the word "printer" encompasses any apparatus that performs a print outputting function for any purpose, such as a digital copier, bookmaking machine, facsimile machine, a multi-function machine, electrostatographic device, etc.

An embodiment of the present teachings may include a printhead including the use of a plurality of thermo-pneumatic actuators (TPA's) to eject ink through a plurality of nozzles onto a recording medium such as paper. A working fluid of each TPA may be separated from a pumped fluid by an actuatable membrane and may have a high boiling point and low thermal conductivity. The working fluid is selected such that a TPA incorporating such working fluid can operate at elevated temperature, for example, above about 100° C., such as at about 115° C., to improve frequency response.

Figure 1:
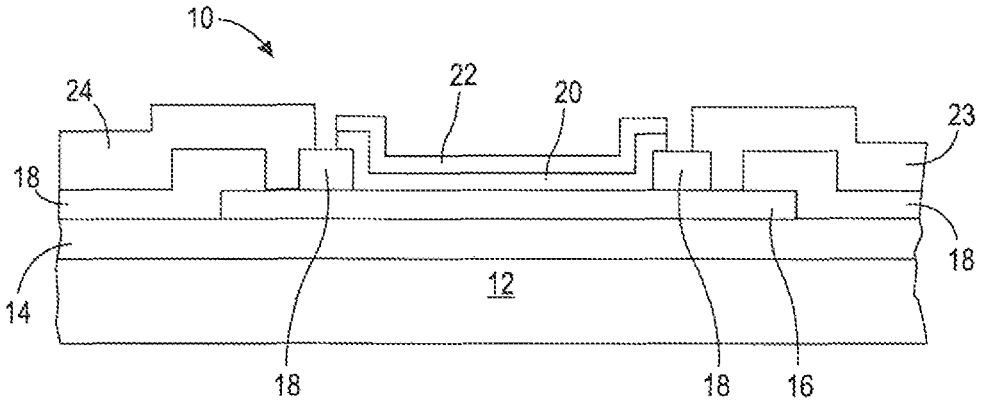
FIGS. 1-6 are cross sections depicting in-process structures in accordance with an embodiment of the present teachings.

U.S. Pat. Nos. 6,315,398 and 5,539,437 which are incorporated by reference above, each separately disclose printing devices. In-process structures which can be formed during an embodiment of the present teachings are depicted in FIGS. 1-6. FIG. 1 depicts an exemplary heater wafer 10 that may be formed by one of ordinary skill in the art and used in an embodiment of the present teachings, although other heater designs are contemplated. It will be understood that the embodiments depicted in each of the FIGS. are generalized schematic illustrations and that other components may added or existing components may be removed or modified.

The heater wafer 10 of FIG. 1 includes a substrate 12 such as a semiconductor (silicon, gallium arsenide, etc.) substrate, which may include various other structures such as ion-doped regions, dielectric layers, and conductive layers formed thereon and/or therein (not individually depicted for simplicity). Further, an underglaze layer 14, for example a dielectric insulating layer such as silicon dioxide ($SiO_2$), may be formed as an isolation region. A patterned resistor 16 (i.e., a resistive heating element) which can be configured to perform as a heater for heating working fluid may then be formed on the underglaze layer 14 using, for example, a chemical vapor deposition (CVD) of polysilicon, a metal, or a metal alloy. In an embodiment, the resistive heating element may be formed of platinum or aluminum.

Figure 4:
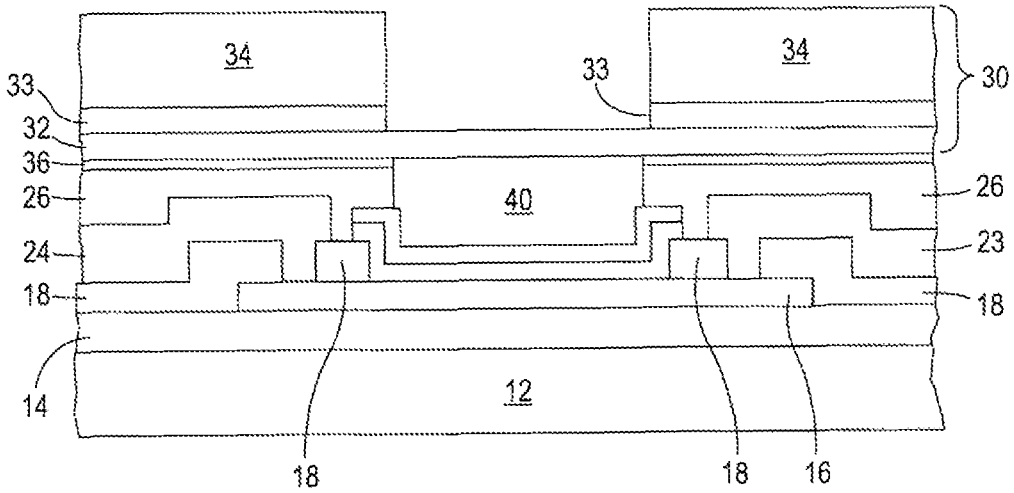
Figure 5:
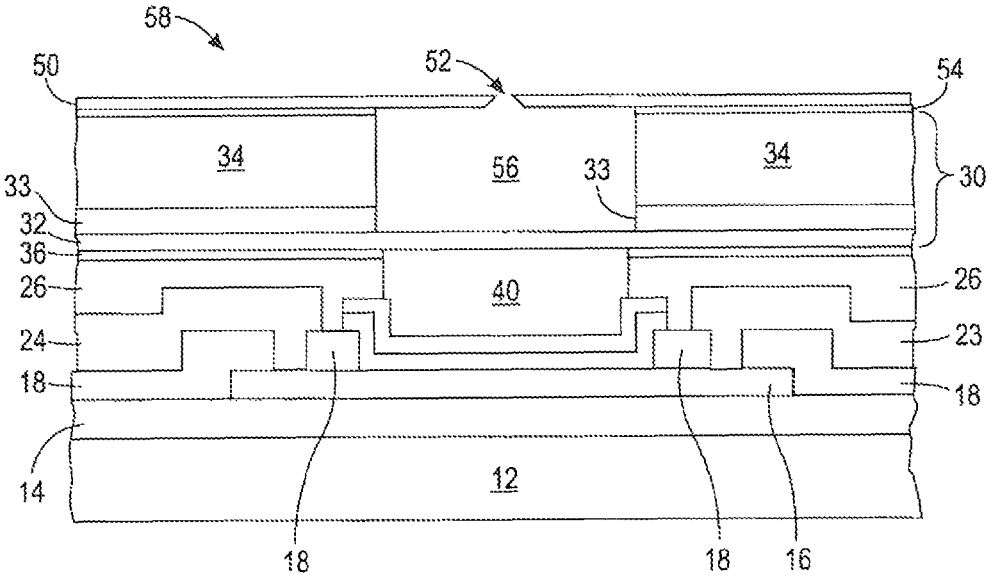

It will be appreciated that, while only one resistor 16 is depicted in FIG. 1, a plurality of resistors 16, as well as the other structures of FIGS. 1-6, may be repeated across the substrate 12 and simultaneously formed as a resistor array, with one resistor 16 associated with each nozzle 52 or ink chamber 56 (FIG. 5, discussed below). Further, in another embodiment, each resistor 16 of the heater wafer 10 may be provided by one or more implanted region within the substrate 12 (not individually depicted for simplicity) rather than being a separate individual layer overlying the substrate 12 as depicted in FIG. 1. It will thus be appreciated that the FIGS. are schematic depictions and that other structural components may be added or existing structural components and/or processing stages may be removed or modified. Each resistor 16 of the resistor array will thus be formed as part of an actuator for ejecting ink from a nozzle. The resistor array is thus part of an actuator array configured to eject ink from an array of nozzles.

Subsequently, a dielectric layer 18, for example phosphosilicate glass (PSG), is formed, planarized, and patterned to leave contact openings to the resistor 16. Next, a dielectric passivation layer 20 and a protective layer 22 of a material such as tantalum are formed and patterned as depicted. The dielectric passivation layer 20 prevents physical contact between the resistor 16 and the possibly corrosive working fluid during use of the device, while the protective layer 22 protects the passivation layer 20 from similar ink contact. In other embodiments, the dielectric passivation layer 20 and/or the protective layer 22 may be omitted such that the heating element is exposed and configured to directly contact portions of the working fluid.

To complete the FIG. 1 heater wafer 10, an electrode layer, for example a layer of aluminum or other conductor, is deposited using, for example, sputtering or CVD, then etched to form a first electrode 23 and a second electrode 24 such that each resistor 16 in the resistor array is individually addressable.

Figure 2:
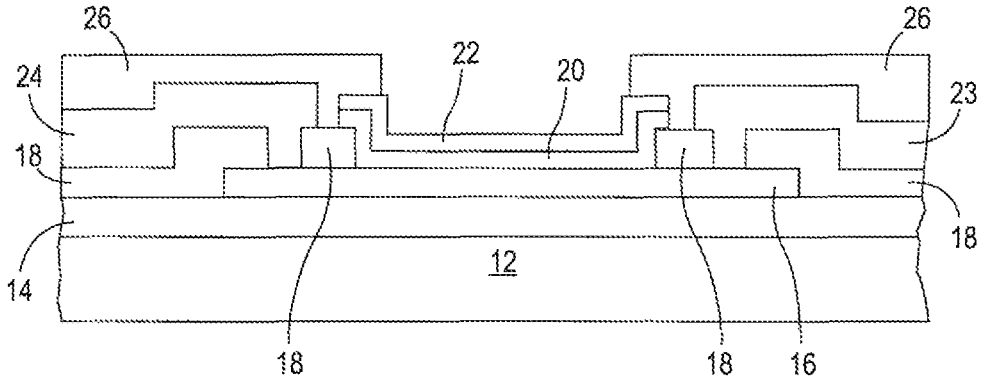

Next, as depicted in FIG. 2, a standoff layer 26, for example PSG, $SiO_2$, SU-8 photoresist, etc., is formed, planarized, and patterned as depicted. The standoff layer 26 may function as an overglaze passivation layer which provides a stable, planar base for subsequent processing as well as a containment structure for the working fluid as described below. The standoff layer 26 may also be used to define a height of a working fluid chamber 40 (FIG. 4). In an embodiment, standoff layer 26 may have a thickness of between about 0.025 μm and about 2.5 μm, or between about 0.1 μm and about 0.2 μm thick, although other thicknesses are contemplated depending on the device design.

Figure 3A:
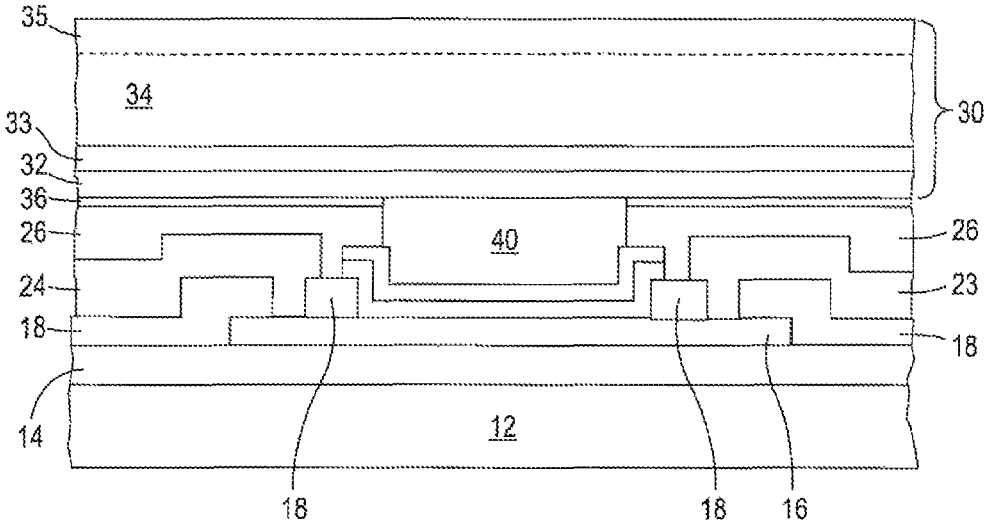

Subsequently, a membrane layer 32 and a support layer 34 are attached to the FIG. 2 structure as depicted in FIG. 3. In an embodiment, the membrane layer 32 and the support layer 34 may be part of a silicon-on-insulator (SOI) wafer 30 that includes other layers such as a buried layer 33, for example a buried oxide layer. Thus, in an embodiment, the SOI wafer 30 may include an actuatable membrane 32, for example a monocrystalline first silicon layer having a thickness of between about 1.0 μm and about 20 μm, or between about 10 μm and about 12 μm. The SOI wafer may further include a dielectric layer 33, such as an oxide layer, for example a buried oxide layer, having a thickness of between about 0.01 μm and about 5.0 μm thick. The SOI wafer may further include a second silicon layer 34, for example a silicon handle layer (i.e., silicon handle wafer), having a thickness of between about 500 μm and about 800 μm. The buried oxide layer 33 is interposed between, and physically separates, the membrane layer 32 from the handle layer 34. The actuatable membrane 32 may be attached to the standoff layer 26 using an adhesive 36 such as an epoxy, such as a spin-coated, evaporated, vapor deposited, sprayed, etc. epoxy, a resin adhesive, or other materials that are suitably compatible with working fluid and meets processing conditions. Further, the adhesive 36 may be applied to the membrane layer 32 and/or the standoff layer 26 using, for example, screen printing, contact printing, etc. In another embodiment, the membrane layer 32 may be attached to the standoff layer 26 using an anodic or fusion bonding or metal diffusion with silver, gold, etc. As depicted in FIG. 3A, a portion 35 of the silicon handle layer 34 may be optionally removed or planarized to thin the SOI wafer, for example decrease an etch time of a subsequent etch of the silicon handle layer 34. Removal of portion 35 may also be used to define a height of an ink chamber 56 (FIG. 5). The portion 35 of handle layer 34 may be removed either before or after attachment to the standoff layer 26, but additional support provided to the SOI wafer 30 by the FIG. 2 structure after attachment may reduce or eliminate damage to the SOI wafer during the thinning process. Thinning may be performed using a chemical wet or dry etch, a mechanical dry etch, a chemical mechanical planarization (CMP), or an abrasion process.

In another embodiment, the actuatable membrane layer 32 and the support layer 34 may be separately attached. For example, the membrane 32 may be a polymer layer, a metal layer, such as a stainless steel layer, a silicon layer, or another layer that is sufficiently thin and flexible to deflect under pressure as described below attached to the standoff layer 26 using adhesive 36. In embodiments, the material for the actuatable membrane layer 32 can be selected from glasses, ceramics and oxides or nitrides. After attaching the membrane 32, a support layer 34, for example an oxide or a nitride, may be deposited on the membrane 32 using a suitable deposition technique. Further, the support layer 34 may be optionally removed or planarized to thin the support layer 34 wafer, for example decrease an etch time of a subsequent etch of the support layer 34. Removal of a portion of the support layer 34 may also be used to define a height of an ink chamber 56 (FIG. 5). Thinning may be performed using a chemical wet or dry etch, a mechanical dry etch, a chemical mechanical planarization (CMP), or an abrasion process. In an alternative process in which the actuatable membrane 32 and the support layer 34 are separately attached, a titanium foil as the actuatable membrane can be bonded to the standoff layer 26 by silver diffusion bonding.

Figure 3B:
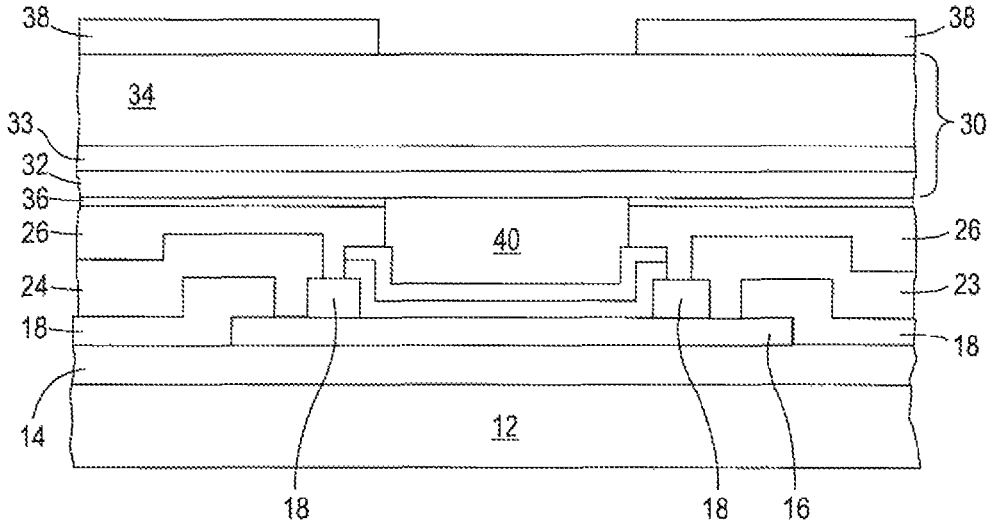

Subsequently, a patterned photoresist layer 38 may be formed over the support layer 34, such that the patterned photoresist layer 38 exposes the support layer 34 at a location which overlies a working fluid chamber 40 as depicted in FIG. 3B. Each working fluid chamber 40 within the array of resistors 16 will be similarly exposed by the patterned photoresist layer 38.

Next, an anisotropic etch of the silicon handle layer 34 and, optionally, the oxide layer 33 is performed to form a plurality of recesses within the silicon handle layer 34 and, optionally, the oxide layer 33, wherein one recess is formed over each resistor 16 as depicted in FIG. 4. In an embodiment, the buried oxide layer 33 may be used as an etch stop during the etch of the silicon handle layer 34. In another embodiment, the buried layer 33 is used as an etch stop during the etch of the support layer 34, and the membrane 32 is used as an etch stop during the etch of the buried layer 33. After completion of the etch, the patterned photoresist layer 38 is removed to result in a structure similar to that depicted in FIG. 4. It will be appreciated that a device formed in accordance with an embodiment of the present teachings may include various other structures known in the art that are not depicted for simplicity, such as structures that allow an ink feed manifold to be distributed across the printhead.

After forming a structure similar to that depicted in FIG. 4, a suitable nozzle plate 50 having a plurality of nozzles 52 is formed and bonded to the top of the SOI wafer 30 using, for example, an adhesive 54 as depicted in FIG. 5. The nozzle plate 50 may be silicon, glass, one or more of various metals such as stainless steel, a polymer, or combinations thereof. In another embodiment, the nozzle plate 50 is attached to the SOI wafer 30 using fusion or another method. Attaching the nozzle plate 50 forms an ink chamber 56 defined by the membrane 32, the support layer 34, and the nozzle plate 50, and completes the array of actuators 58. In a printhead having intervening features such as a manifold, ink routing layers, and/or other layers interposed between the nozzle plate 50 and the support layer 34, the nozzle plate 50 may be indirectly attached to the support layer 34 through contact with, and direct attachment to, the intervening feature rather than being directly attached to the support layer 34.

After completing a structure similar to that depicted in FIG. 5, processing may continue to form a completed thermopneumatic actuator TIJ printhead. This may include filling the fluid chamber 40 with a working fluid 60 (FIG. 6) and filling the ink chamber 56 with ink 62.

The membrane layer 32 provides, and functions in the completed printhead, as a thermo-pneumatic actuator membrane 32 to separate the working fluid chamber 40 from the ink chamber 56 across one or more, such as a plurality of individual actuators of the actuator array. The working fluid 60 may be selected such that a boiling temperature of the working fluid may be in a range of greater than about 100° C. to about 500° C. which can be at ambient pressure, for example, in a range of about 150° C. to about 350° C. which can be at ambient pressure. Some examples of working fluid are provided in Table 1 below. In some embodiments, the materials usable as working fluids can be those that meet predetermined MSDS health, fire and reactivity ratings. For example, the working fluids can be selected from materials having an MSDS health hazard rating of 0, 1, or 2, an MSDS fire rating of 0 or 1, and/or an MSDS reactivity rating of 0.

600° C. In an embodiment a thermal conductivity of the substrate 12 may be greater than a thermal conductivity of the working fluid 60, which may be less than about 0.2 W/m-K. The working fluid 60 may be selected, such that a flash point of the working fluid is greater than or equal to about 60° C. because, while not limited to a particular theory, it is believed that materials having flash points lower than 60° C. are considered flammable. In an example, the working fluid can include 1,3-butanediol, 1-decanol, diethyl malonate, dihexyl ether, dimethyl phthalate, 1-dodecanol, n-heptadecane, n-hexadecane, methyl salicylate, n-pentadecane, phentlethyl alcohol, 2-pyrrolidinone, n-tetradecane, tetrahydrofurfuryl alcohol, triethylene glycol, or combinations thereof. In order to achieve desirable commercial characteristics, the working fluid can be non-halogenated, may not cause severe health hazards, and may not be severely corrosive or reactive, according to MSDS health hazard rating, MSDS fire hazard rating and/or MSDS reactivity ratings.

TABLE 1

| Material Name | Thermal Conductivity (W/m-K) | Density (g/cc) | Specific Heat (J/g/C.) | Boiling Point (° C.) | Flash Point (° C.) | Critical Temp (° C.) | MSDS Health, Fire, & Reactivity & Notes |
|---|---|---|---|---|---|---|---|
| Benzyl benzoate, C14H12O2 | 0.137 | 1.12 | | 324 | 148 | 548 | 1, 1, 0 |
| 1,3-Butanediol, C4H10O2 | 0.184 | 1 | 2.52 | 208 | 108 | 403 | 1, 1, 0 irritating |
| 1-Decanol, C10H22O | 0.162 | 0.83 | 2.38 | 230 | 108 | 417 | Irritating to eyes |
| Diethyl malonate, C7H12O4 | 0.13 | 1.049 | 1.87 | 200 | 200 | | 0, 1, 0, irritant |
| Dihexyl ether, C12H26O | 0.133 | 0.794 | | 227 | 97 | | Irritating |
| Dimethyl phthalate, C10H10O4 | 0.146 | 1.19 | 1.56 | 284 | 146 | | 0, 1, 0 |
| 1-Dodecanol, C12H26O | 0.146 | 0.835 | 2.48 | 260 | 127 | 446 | 0, 1, 0 |
| n-Heptadecane, C17H36 | 0.145 | 0.778 | 2.22 | 302 | 149 | 461 | 2, 1, 0 Irritant |
| n-Hexadecane, C16H34 | 0.141 | 0.773 | 2.26 | 287 | 93 | 449 | 0, 1, 0 slight irritant |
| Methyl salicylate, C8H8O3 | 0.147 | 1.184 | 1.94 | 219 | 98 | 436 | 1,1,0 Very hazardous for ingestion; hazardous for contact. |
| n-Pentadecane, C15H32 | 0.14 | 0.769 | 2.21 | 271 | 132 | 435 | 1, 1, 0 irritant |
| Phenylethyl alcohol, C8H10O | 0.164 | 1.02 | 2.07 | 219 | 96 | | 1, 1, 0 irritant: penatrant |
| 2-Pyrrolidinone, C4H7NO | 0.194 | 1.1 | 1.59 | 245 | 98 | | 2, 1, 0 irritant |
| n-Tetradecane, C14H30 | 0.136 | 0.763 | 2.2 | 254 | 99 | 420 | 2, 1, 0 irritant |
| Tetraethylene glycol, C8H18O5 | 0.161 | 1.13 | 2.19 | 327 | 110 | 508 | 2, 1, 0 irritant |
| Tetrahydrofurfuryl alcohol, C5H10O2 | 0.146 | 1.048 | 1.774 | 178 | 165 | | 2, 1, 0 irritant |
| Triethylene glycol, C6H14O4 | 0.197 | 1.12 | 2.162 | 287 | 177 | 482 | 1, 1, 0 Very hazardous for contact. Toxic to organs |

In an embodiment, a working fluid is selected such that a critical temperature of the working fluid is in a range of about 250° C. to about 700° C., for example, about 350° C. to about Various inks 62, such as aqueous and non-aqueous inks, UV inks, gel inks, conductive inks, and biological fluids may be used in an embodiment of the present teachings.

Figure 6:
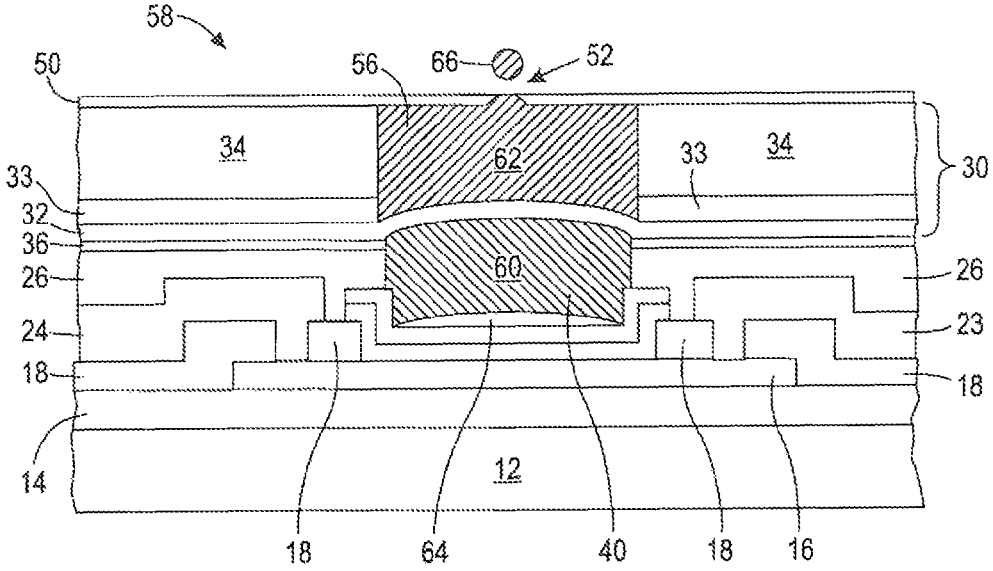

During use of the printhead as depicted in FIG. 6, the resistor 16 may be individually addressed by applying a voltage across the two electrodes 23, 24, which results in heating of the resistor 16. Once the resistor 16 reaches a critical temperature, the working fluid 60 begins to vaporize, for example by forming a plurality of bubbles that can coalesce and forms a bubble 64, which pressurizes the working fluid chamber 40. The resulting pressure within the working fluid chamber 40 causes the membrane 32 to deflect, thereby decreasing a volume of the ink chamber 56. The volumetric decreases results in ejection of ink 62 from the nozzle 52 as an ink drop 66, which is thereby deposited onto a recording medium (not individually depicted for simplicity). Because a boiling temperature of the working fluid may be in a range of greater than about 100° C. to about 500° C., the printhead may be operated at a higher frequency compared to conventional printheads. For example, in an embodiment, the thermo-pneumatic actuator is maintained at a steady state temperature that is lower than the boiling point temperature of the working fluid. As an example, the printhead can be operated at, for example, a steady state temperature target of 115° C. and at a peak temperature target of greater than 450° C. An electrical signal having a pulsewidth of, for example, about 5 microseconds, can be provided to energize the heating element of the printhead. The printhead can be operated at a frequency of about 7 kHz to a frequency of about 10 kHz, but may not be limited to such frequencies.

Figure 7:
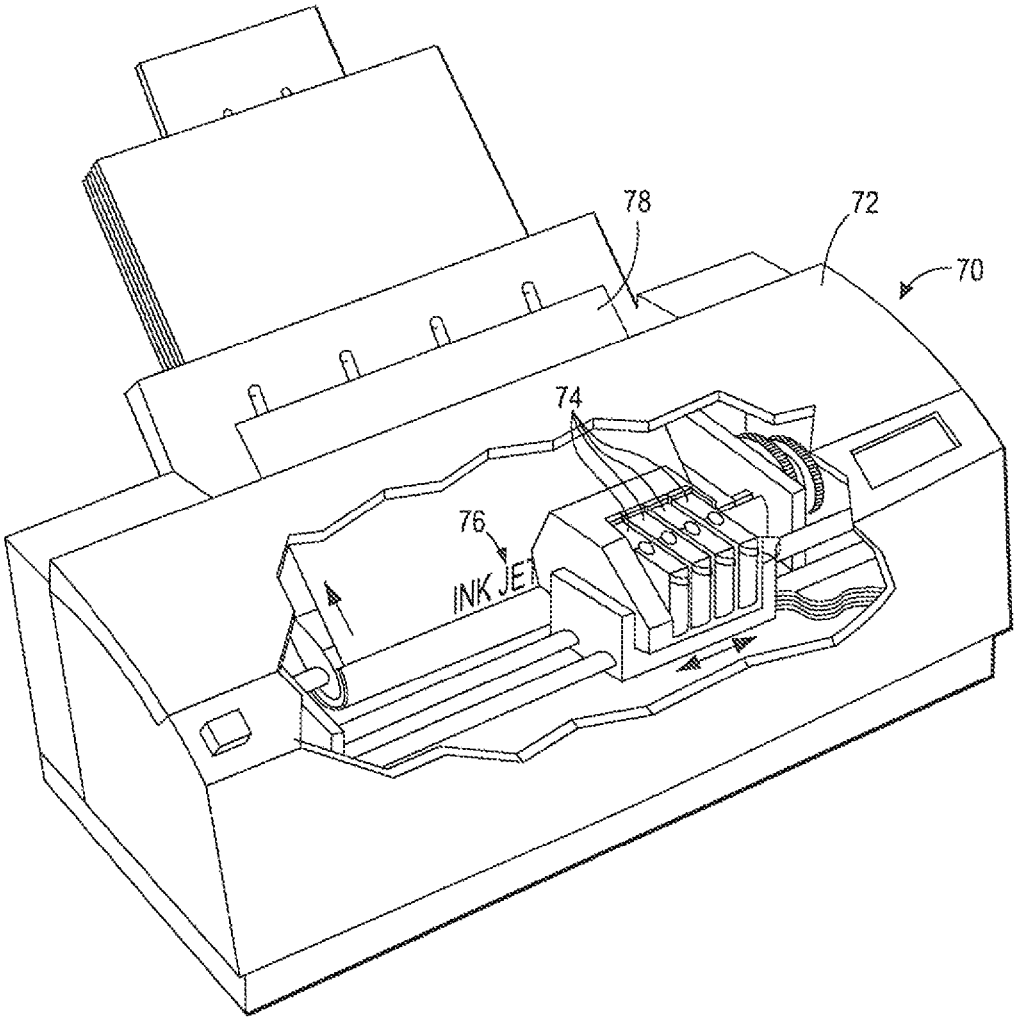
FIG. 7 is a perspective depiction of a printer in accordance with an embodiment of the present teachings.

FIG. 7 depicts a printer 70 including a printer housing 72 into which at least one printhead 74 including an embodiment of the present teachings has been installed. The housing 72 may encase the printhead 74. During operation, ink 76 is ejected from one or more printheads 74. The printhead 74 is operated in accordance with digital instructions to create a desired image on a print medium 78 such as a paper sheet, plastic, etc. The printhead 74 may move back and forth relative to the print medium 78 in a scanning motion to generate the printed image swath by swath. Alternately, the printhead 74 may be held fixed and the print medium 78 moved relative to it, creating an image as wide as the printhead 74 in a single pass. The printhead 74 can be narrower than, or as wide as, the print medium 78. In another embodiment, the printhead 74 can print to an intermediate surface such as a rotating drum, belt, or drelt (not depicted for simplicity) for subsequent transfer to a print medium.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10"can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10"can assume negative values, e.g. −1, −2, −3, −10, −20, −30, etc.

While the present teachings have been illustrated with respect to one or more implementations, alterations and/or modifications can be made to the illustrated examples without departing from the spirit and scope of the appended claims. For example, it will be appreciated that while the process is described as a series of acts or events, the present teachings are not limited by the ordering of such acts or events. Some acts may occur in different orders and/or concurrently with other acts or events apart from those described herein. Also, not all process stages may be required to implement a methodology in accordance with one or more aspects or embodiments of the present teachings. It will be appreciated that structural components and/or processing stages can be added or existing structural components and/or processing stages can be removed or modified. Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. Finally, "exemplary" indicates the description is used as an example, rather than implying that it is an ideal. Other embodiments of the present teachings will be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a workpiece, regardless of the orientation of the workpiece. The term "horizontal" or "lateral" as used in this application is defined as a plane parallel to the conventional plane or working surface of a workpiece, regardless of the orientation of the workpiece. The term "vertical" refers to a direction perpendicular to the horizontal. Terms such as "on," "side" (as in "sidewall"), "higher," "lower," "over," "top," and "under" are defined with respect to the conventional plane or working surface being on the top surface of the workpiece, regardless of the orientation of the workpiece.

The invention claimed is:

1. A thermo-pneumatic actuator, comprising:

a substrate;

an insulating layer formed on the substrate;

a non-halogenated working fluid disposed in a fluid chamber;

an ink chamber separated from the fluid chamber by at least a portion of the device layer comprising an actuatable membrane; and a heating element formed between the insulating layer and the fluid chamber, wherein a boiling point temperature of the working fluid in the fluid chamber is in the range of greater than about 100° C. to about 500° C., and wherein a flash point of the working fluid is greater than about 60°C.

2. The thermo-pneumatic actuator of claim 1, further comprising an ink disposed in the ink chamber.

3. The thermo-pneumatic actuator of claim 1, wherein a thermal conductivity of the substrate is greater than a thermal conductivity of the working fluid.

4. The thermo-pneumatic actuator of claim 1, wherein a thermal conductivity of the working fluid is less than about 0.2 W/m-K.

5. The thermo-pneumatic actuator of claim 1, wherein the boiling point temperature of the working fluid is in the range of greater than about 150° C. to about 350° C.

6. The thermo-pneumatic actuator of claim 1, wherein the working fluid is selected from the group consisting of benzyl benzoate, 1, 3-butanediol, 1-decanol, diethyl malonate, dihexyl ether, dimethyl phthalate, 1-dodecanol, n-heptadecane, n-hexadecane, methyl salicylate, n-pentadecane, phentlethyl alcohol, 2-pyrrolidinone, n-tetradecane, tetrahydrofurfuryl alcohol, or triethylene glycol.

7. The thermo-pneumatic actuator of claim 1, wherein the actuatable membrane comprises stainless steel.

8. A method for forming a thermo-pneumatic actuator, comprising:

forming an insulating layer on a substrate;

forming a fluid chamber;

forming a heating element between the insulating layer and the fluid chamber;

forming a device layer comprising an actuatable membrane;

forming an ink chamber separated from the fluid chamber by at least a portion of the device layer; and at least partially filling a volume of the fluid chamber with a non-halogenated working fluid, wherein a boiling point temperature of the working fluid in the first reservoir is in the range of greater than about 100° C. to about 500° C., and wherein a flash point of the working fluid is greater than about 60°C.

9. The method of claim 8, further comprising at least partially filling a volume of the ink chamber with ink.

10. The method of claim 8, wherein a thermal conductivity of the substrate is greater than a thermal conductivity of the working fluid.

11. The method of claim 8, wherein a thermal conductivity of the working fluid is less than about 0.2 W/m-K.

12. The method of claim 8, wherein the boiling point temperature of the working fluid is in the range of greater than about 150° C. to about 350° C.

13. The method of claim 8, wherein the working fluid is selected from the group consisting of benzyl benzoate, 1, 3-butanediol, 1-decanol, diethyl malonate, dihexyl ether, dimethyl phthalate, 1-dodecanol, n-heptadecane, n-hexadecane, methyl salicylate, n-pentadecane, phentlethyl alcohol, 2-pyrrolidinone, n-tetradecane, tetrahydrofurfuryl alcohol, or triethylene glycol.

14. The method of claim 8, wherein the actuatable membrane comprises stainless steel.

15. A method of operating a thermo-pneumatic actuator, comprising:

providing a thermo-pneumatic actuator comprising a substrate;

an insulating layer formed on the substrate;

a non-halogenated working fluid disposed in a fluid chamber;

an ink chamber separated from the fluid chamber by at least a portion of the device layer comprising an actuatable membrane; and a heating element formed between the insulating layer and the fluid chamber, wherein a boiling point temperature of the working fluid in the fluid chamber is in the range of greater than about 100° C. to about 500° C., and wherein a flash point of the working fluid is greater than about 60°C.;

activating the heating element to heat at least a portion of the working fluid such that at least a vapor bubble forms in the fluid chamber; and actuating the actuatable membrane to cause the ejection of ink from the ink chamber, wherein the thermo-pneumatic actuator is maintained at a steady state temperature that is lower than the boiling point temperature of the working fluid.

16. The method of claim 15, wherein a thermal conductivity of the working fluid is less than about 0.2 W/m-K.

17. The method of claim 15, wherein the working fluid is selected from the group consisting of benzyl benzoate, 1, 3-butanediol, 1-decanol, diethyl malonate, dihexyl ether, dimethyl phthalate, 1-dodecanol, n-heptadecane, n-hexadecane, methyl salicylate, n-pentadecane, phentlethyl alcohol, 2-pyrrolidinone, n-tetradecane, tetrahydrofurfuryl alcohol, or triethylene glycol.

* * * * *